US006290744B1

(12) United States Patent
Fujimaru et al.

(10) Patent No.: US 6,290,744 B1
(45) Date of Patent: Sep. 18, 2001

(54) SINTER OF NOBLE METAL AND METHOD FOR PRODUCTION THEREOF

(75) Inventors: Atsushi Fujimaru, Fuchu; Katsuhiko Shimamoto, Hino; Hitoshi Araki, Tachikawa; Makoto Miyata, Tokorozawa, all of (JP)

(73) Assignee: Aida Chemical Industries Co., Ltd., Tokyo (JP)

( * ) Notice: Subject to any disclaimer, the term of this patent is extended or adjusted under 35 U.S.C. 154(b) by 0 days.

(21) Appl. No.: 09/443,439

(22) Filed: Nov. 19, 1999

(30) Foreign Application Priority Data

Feb. 12, 1999 (JP) ..... 11-033631

(51) Int. Cl.[7] ..... C22C 1/04; C22C 5/00; C22C 5/02; B22F 3/12

(52) U.S. Cl. ..... 75/247; 419/36; 419/38

(58) Field of Search ..... 75/247; 419/38, 419/36

(56) References Cited

U.S. PATENT DOCUMENTS 2,188,873 * 1/1940 Comstock ..... 29/160.5
2,556,921 * 6/1951 Hirsch et al. ..... 75/22
3,606,766 * 9/1971 Hill ..... 63/15
3,669,634 * 6/1972 Peters et al. ..... 29/182.1
4,434,211 * 2/1984 Shoher et al. ..... 428/552
5,000,779 * 3/1991 German et al. ..... 75/244
5,401,695 * 3/1995 Wu ..... 501/87
5,702,501 * 12/1997 Osawa et al. ..... 75/255

* cited by examiner

*Primary Examiner*—Daniel Jenkins
(74) *Attorney, Agent, or Firm*—Breiner & Breiner

(57) ABSTRACT

A sinter of noble metal produced by forming in a required shape or attaching to a given object a plastic art grade clayish composition or adhesion composition comprising a noble metal powder containing at least one member selected from the group consisting of pure noble metal powders and noble metal alloy powders, 0.022–3.0 wt. % of a water-soluble cellulose type resin, 0.02–3.0 wt. % of starch, or 0–0.5 wt. % of a reticular macromolecular substance formed by condensation of a component unit having phenyl propane as a backbone as an organic type binder, and water, drying to hardness the shaped composition or adhering composition, and sintering the hardened shaped composition or adhering composition at a temperature in the range of from the melting point of the noble metal and 70° C. lower than the melting point. A method for the production of the sinter of noble metal. A sinter of noble metal and an attached sinter of noble metal.

8 Claims, 4 Drawing Sheets

SINTER OF NOBLE METAL AND METHOD FOR PRODUCTION THEREOF

BACKGROUND OF THE INVENTION

1. Field of the Invention

This invention relates to sinters of noble metal and a method for the production of sinters of noble metals to be used for the manufacture of shaped products of noble metals abounding in craftsmanship, such as, for example, ornaments of noble metals, artistic craft products, and decorations, and more particularly, to a method for the production of sinters of noble metals which experience only slight shrinkage in the course of sintering and which possess high strength.

2. Description of the Prior Art

The conventional procedure adopted, for the production of sinters of noble metals has been to elevate the temperature of the raw material for sintering slowly in an electric furnace or oven and heat and fire the material over a long time lest the sinter should sustain deformation or fracture such as cracks.

Commercially available clayish compositions for shaping noble metals are obtained by suitably mixing a nobel metal powder, an organic binder, and a solvent as basic materials. When necessary, a surfactant is combined as a mixture promoting agent, along with an oily fat and a plasticizer as agents for preventing the mixture in process of production from adhering to the hands of the artist until the mixture assumes the clayish compositon. The noble metal powder in the clayish composition mainly comprises granulated, shaped, or flat particles having an average particle diameter of 20 $\mu$m. As the organic binder, water-soluble cellulose type resin, an acryl type resin, a polyvinyl alcohol type resin, or wax is used at a content in the approximate range of 15–30 wt. %. As the plasticizer, a phthalic ester, a higher fatty acid, a higher fatty ester, or liquid paraffin is used.

Then, the desired sinter of the noble metal is obtained by forming the clayish composition in a prescribed shape, drying the shaped composition, and slowly elevating the temperature of the dried composition in an electric furnace or oven from normal room temperature until it is heated and fired.

The conventional method of production described above is disadvantageous particularly when a plasticizer, a surfactant, an oily fat, and other similar components are mixed in and the mixture is quickly fired. Specifically, the sinter is liable to deform or sustain fracture, such as a crack, owing to quick decomposition, evaporation, combustion, etc. of such organic components. It therefore requires complicated temperature control during firing and inevitably requires the sintering to be continued for a long time (2–10 hours). The cost of the energy consumed in consequence of the protracted firing is enormous. In recent years clayish compositions of noble metal have come to be used in large volume in the field of ornaments and have come to be used particularly in culture classes. The protracted firing time seriously dampens the artist's enthusiasm about creating an ornament. Further, after the electric furnace or oven has been heated to a high temperature for firing a dry shaped composition, its interenal temperature must be returned to normal room temperature by cooling in preparation for firing the next ornament in the subsequent cycle of production, with immense waste of time and energy.

Since the total content of the organic components such as plasticizer, surfactant, and oily fat is high, falling in the range of 15–30 wt. %, the shaped composition in the process of manufacture is markedly shrunken by the sintering and the sinter finally obtained differs from the original artist conceptions. The shaping of the clayish composition therefore must be carried out with allowance for the shrinkage. Since the sinter assumes a porous texture of low strength, its ornamental property tends to be degraded by deformation of the shaped composition under its own weight in the process of firing and deformation that the shaped composition sustains after the firing from a shock or under a load. When the clayish composition is diluted with water and deposited in the form of a thin film on the surface of an object, for example, the thin film of composition sustains numerous cracks due to shrinkage and completely fails to produce the expected ornamental property.

Thus, a strong need is felt for a method for the production of sinters of noble metal which lowers the energy cost by shortening the process of firing after the step of drying and enables formation of the fired composition with minimal shrinkage, thereby maintaining the ornamental property and ensureing high strength.

SUMMARY OF THE INVENTION

This invention was accomplished to overcome the drawbacks of the prior art described above. It specifically concerns a sinter of noble metal obtained by forming in a required shape or causing to adhere to an object a composition containing at least 78 wt. % of a noble metal powder of at least one member selected from nobel metal powders and noble metal alloy powders, 0.022–3.0 wt. % of a water-soluble cellulose type resin as an organic type binder, 0.02–3.0 wt. % of starch or 0–0.5 wt. % of a reticular macromolecular compound formed by condensation of a component unit having phenyl propane as a backbone, and water, drying and solidifying the shaped composition or adhering composition, and rapidly heating and firing the dried shaped or adhering composition, and a method for the production of the sinter of noble metal.

DESCRIPTION OF THE PREFERRED EMBODIMENT

Figure 1:
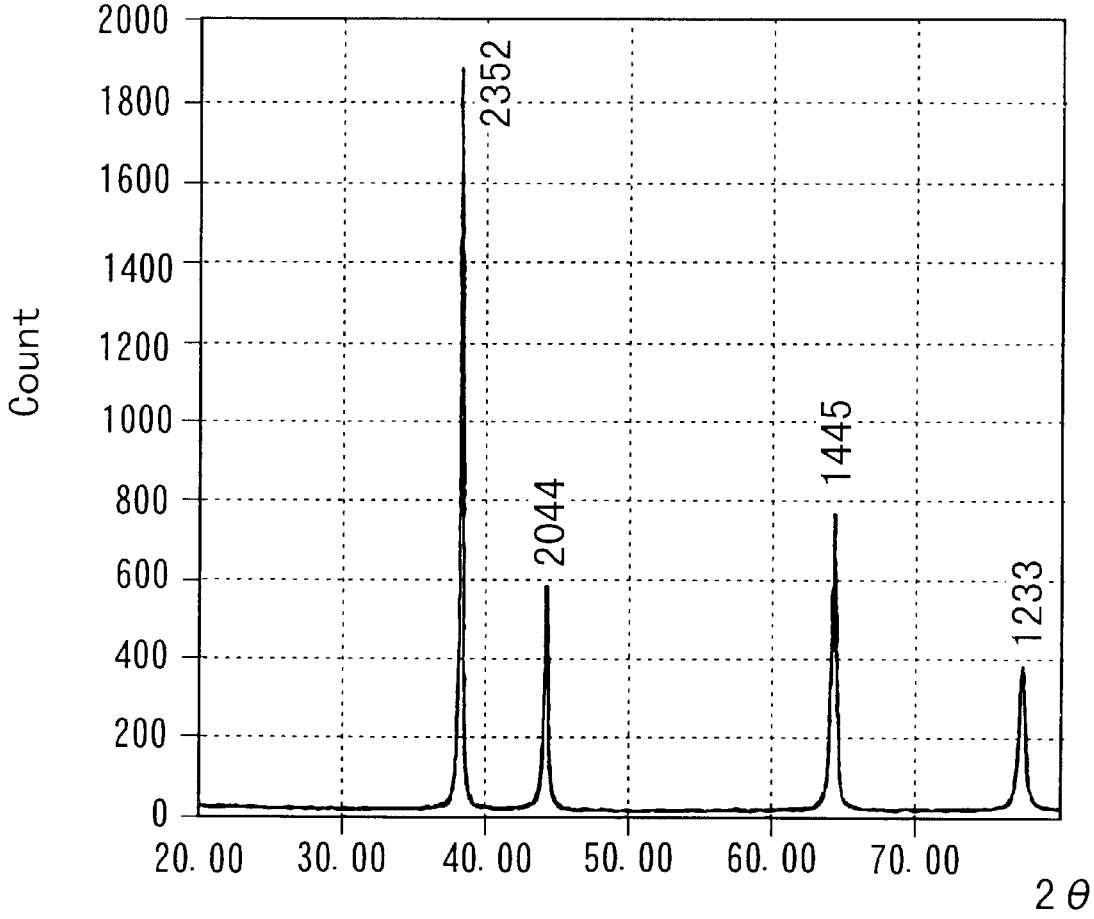
FIG. 1 is a chart showing the results of an X-ray analysis performed on a sample of silver-containing clayish composition by a procedure of heating the sample to 900° C. over a period of about one hour and then retaining the sample at 900° C. for 30 minutes in accordance with the conventional method.

The noble metal powder in the clayish composition to be used in this invention for the production of a sinter of noble metal is formed of at least one member selected from the group consisting of such pure noble metals as Au, Ag, Pt, Pd, Rh, Ru, Ir, and Os and such noble metal alloys having at least one of the elements mentioned above as a main component thereof. The content of the noble metal powder in the composition is at least 78 wt. %. If this content fails to reach 78 wt. %, the sinter of this composition has a very low value as a product. The powder appropriate for this invention is such that particles 1–100 μm in diameter account for not less than 90% of all the particles of the powder. A powder having particles of an average diameters of 5–30 μm suitably distributed among all the particles thereof is particularly preferable. The powder of this description enhances packing density of the powder and consequently allows production of a sinter of noble metal which incurs only slight shrinkage during the process of sintering because the small particles mingle with the large particles and fill up the gaps intervening between the large particles.

The mixed compositions is enabled to acquire fully satisfactory plasticity (shaping property and film-forming property) by using 0.022–3.0 wt. % of a water-soluble cellulose type resin as a water-retaining agent, 0.02–3.0 wt. % of starch (a starch) as a thickener, or 0–0.5 wt. % of a reticular macromolecular compound obtained by condensation of a component unit having phenyl propane as a backbone as an organic type binder.

The incorporation of the water-soluble cellulose type resin prevents the applied raw layer of the composition from sustaining cracks and prevents the clayish composition from adhering to the hands. If the amount incorporated is smaller than the lower limit of the range mentioned above, the effect of the incorporation will not be fully manifested. If the amount incorporated is larger than the upper limit of the range, the clayish composition will readily adhere to the hands and the shrinkage ratio will increase. Specific examples of water-soluble cellose type resins usable in this invention include methyl cellulose, hydroxyethyl cellulose, hydroxypropyl cellulose, and hydroxypropyl methyl cellulose.

The incorporation of starch enhances the strength of the applied layer of the composition in a dried state. When the composition is extruded through an injection syringe, for example, to produce a three-dimensional ornament of a very thin line, the ornament will not be deformed or fractured during the process of drying. If the amount incorporated is smaller than the lower limit of the range mentioned above, the shaped composition will have insufficient strength during the process of drying and tend to sustain fracture during the process of mold release. If the amount incorporated is larger than the upper limit of the range mentioned above, the composition will become elastic and be difficult to form in the desired shape. Moreover, the shaped raw composition will sustain fracture and increased shrinkage.

Lignin may be cited as a concrete example of the reticular macromolecular substance that results from the condensation of the component unit having phenyl propane as a backbone. The incorporation of this substance imparts a water-retaining property to the composition and prevents the clayish composition from adhering to the hands. These effects are not fully obtained if the amount incorporated is smaller than the lower limit of the range mentioned above. If the amount of the incorporation exceeds the upper limit of the range mentioned above, the composition will again tend to adhere to the hands and will gain in shrinkage.

The water to be mixed with the noble metal powder together with the organic type binder must be added in the required amount. This amount is appropriately selected in light of the purpose for which the produced composition is to be used, i.e., whether the composition is intended for plastic art grade clayish compositon or for adhesion type compositon. In the case of the plastic art grade clayish composition, if the amount of the water is unduly small, the composition will become hard and difficult to form in to the desired shape. If the amount of the water is unduly large, the composition will no longer possess a shape-retaining property and will be difficult to form in to the desired shape. In the case of the adhesion type composition, the composition will be deficient in spreading property and will no longer adhere to the object if the amount of the water is unduly small, whereas the composition will not produce a uniform film if the amount of the water is unduly large.

This invention begins the production of a sinter of noble metal by either forming in a necessary shape the plastic art grade clayish composition formed of the components mentioned above or causing the adhesion type composition to adhere to a suitable article, and then drying the formed composition or adhering composition at a temperature in the range of 50–80° C. for about one hour. The drying conditions just mentioned are meant merely as an illustration. The method for the production of a sinter of noble metal contemplated by this invention is not particularly limited as regards the drying means, method, or conditions to be adopted.

For the sinters of noble metals of this class, the salient feature resides in obtaining a sinter of noble metal in an arbitrary shape and further implementing attachment of an ornament of an arbitrary shape to the sinter of noble metal. No restriction of any sort is imposed on the formation of the sinter of noble metal. Sinters of noble metal can be formed in various shapes and designs such as, for example, pendant tops, rings, brooches, and pierces. They may be used in combination with metallic materials which are manufactured as by casting. A metal ring may be preparatorily manufactured as an auxiliary article for plastic art by the lost-wax process, for example, and the adhesion composition contemplated by this invention may be attached to the surface of the metal ring. It is also allowable to use the adhesion composition as an adhesive agent for integrally fixing gem retaining metallic pieces produced for attachment of gems in various shapes like cones, rings, legs, claws, and pins and metallic pieces for attachment such as rings, loket bails, and brooches.

Then, the dry shaped composition is rapidly heated for short time at a temperature in the range of from the melting point of the noble metal powder to 70° C. lower than the melting point, to be fired.

Specifically, the interior of the electric furnace or oven is adjusted in advance to a temperature falling in the range mentioned above and the formed composition already dried and solidified or attached to an object is left standing in the electric furnace or oven for a period of not more than five minutes. As a result, the sinter of noble metal which is obtained enjoys high strength and low shrinkage. If the firing is performed for more than five minutes, the excess firing time produces only a small increase in strength, causes inefficient energy consumption, and aggravates shrinkage. Although a sinter obtained with a longer firing time is higher in strength, it tends to suffer increased shrinkage.

At a temperature not lower than the temperature 70° C. lower than the melting point mentioned above (in the range of temperature from the melting point to 70° C. lower than the melting point), firing performed for two minutes (2–5 minutes) allows the produced sinter of noble metal to acquire fully satisfactory strength.

At a temperature not lower than the temperature 60° C. lower than the melting point mentioned above (in the range of temperature from the melting point to 60° C. lower than the melting point), even firing performed for only one minute (1–5 minutes) allows the produced sinter of noble metal to acquire fully satisfactory strength.

Further, at a temperature not lower than the temperature 30° C. lower than the melting point mentioned above (in the range of temperature from the melting point to 30° C. lower than the melting point), even firing performed for only 45 seconds (45 seconds–5 minutes) allows the produced sinter of noble metal to acquire fully satisfactory strength.

The amply high strength is obtained even by such an extremely brief firing continued for not more than five minutes. Particularly, there exists a temperature range in which the amply high strength is obtained even by firing continued for not more than one minute. It therefore suffices to select the temperature conditions mentioned above and perform the firing under such conditions. When the firing is not sufficient, the sinter obtained is so deficient in strength as to sustain breakage readily.

It was not heretofore known or expected in the field of chemical engineering that such rapid heating, namely the heating performed at the specific temperature for such a brief period as mentioned above (the extremely brief period at a temperature in the range of from the melting point to 70° C. below the melting point), was capable of producing such effects as mentioned above.

The method of this invention embraces a method which effects the firing by rapidly heating the dry shaped composition with a gas burner. Since the outer region of the flame produced by a gas burner reaches a temperature as high as 1300° C., the flame has to be applied in a manner that does not melt the noble metal powder. Specifically, the flame is kept from being applied continuously at any one part of the dried and solidified shaped composition or the adhesion composition deposited on an object (the flame is applied to different parts at different times). The firing is uniformly performed by repeating this procedure while adjusting the gas burner thereby effecting intermittent application of the flame. Though the firing gains in uniformity proportionately to the decrease in the duration of one application of the flame of the burner at one part of the shaped article or the adhesion article, this decrease adds to the complexity of the work by increasing the number of rounds of moving the flame of the burner toward and away from the part for flame application. Conversely, although the ease of work increases proportionately to the increase in the duration of one application of the flame of the burner (though not to an extent of causing the metal to melt), this decrease tends to impair the uniformity of firing. The total length of the time for firing a shaped article, 10 g in weight, though not particularly limit is in the approximate range of 5 seconds–five minutes. Firing by means of a gas burner requires a demanding procedure as compared with firing performed in an electric furnace or oven. The worker conducting this firing can, however, improve his or her skill rather easily because the work can be performed while continuously observing the outcome. This firing also has the advantage of not requiring expensive equipment like an electric furnace or oven.

The firing is effected by rapid heating when performed in the specific temperature atmosphere mentioned above and when performed by the use of a gas burner. The sinter obtained by the firing by rapid heating possesses a clearly different crystal structure and exhibits rather improved strength properties as compared with a sinter obtained by the conventional procedure of slowly elevating the temperature of the shaped composition from room temperature and then firing it for a long time. In short, as demonstrated by X-ray analysis, the rapid heating induces union of the individual particles of the nobel metal powder, adds to the number of planes of junction in the metal, and imparts to the produced sinter a conspicuously different orientation from the sinter obtained by the protracted firing. The half band width is partly broad or split, suggesting the occurrence of transformation or distortion.

Figure 2:
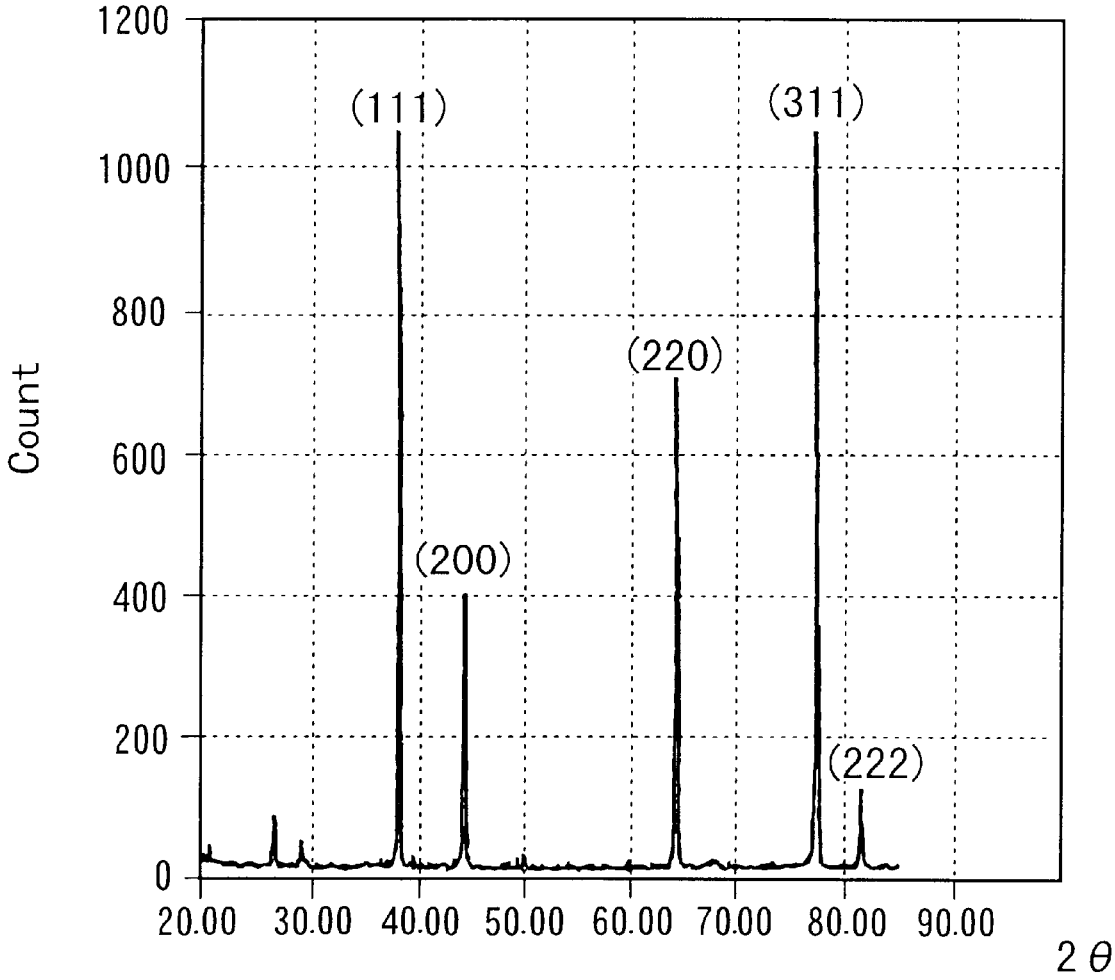
FIG. 2 is a chart showing the results of an X-ray analysis performed on a sample of silver-containing clayish composition by a procedure of placing the sample in an electric furnace kept in advance at 940° C. and then rapidly heating it for three minutes in accordance with the method of this invention.

The results of the X-ray analysis performed on sinters of noble metals are shown in FIG. 1 and FIG. 2.

Figure 3:
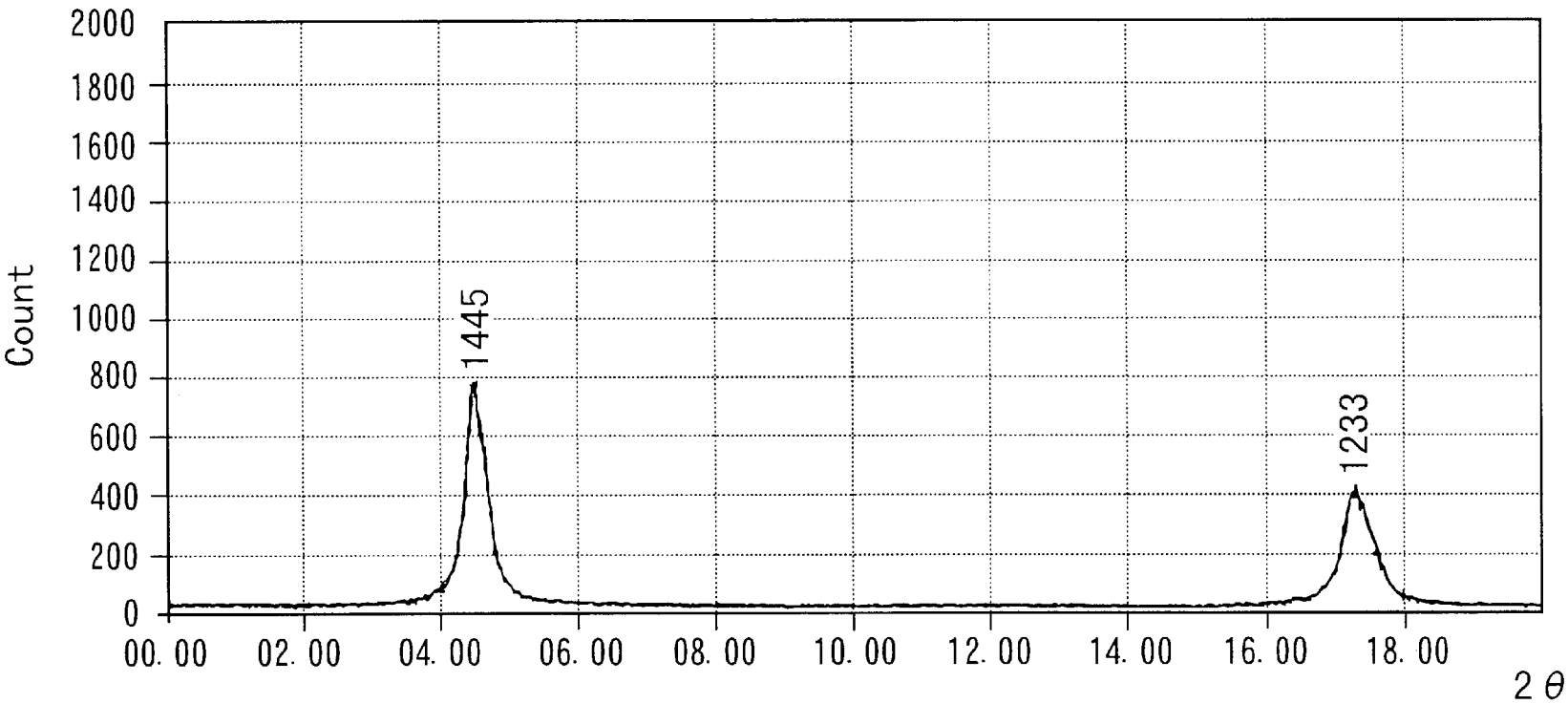
FIG. 3 is a chart showing the X-ray pattern of FIG. 1 as magnified.
Figure 4:
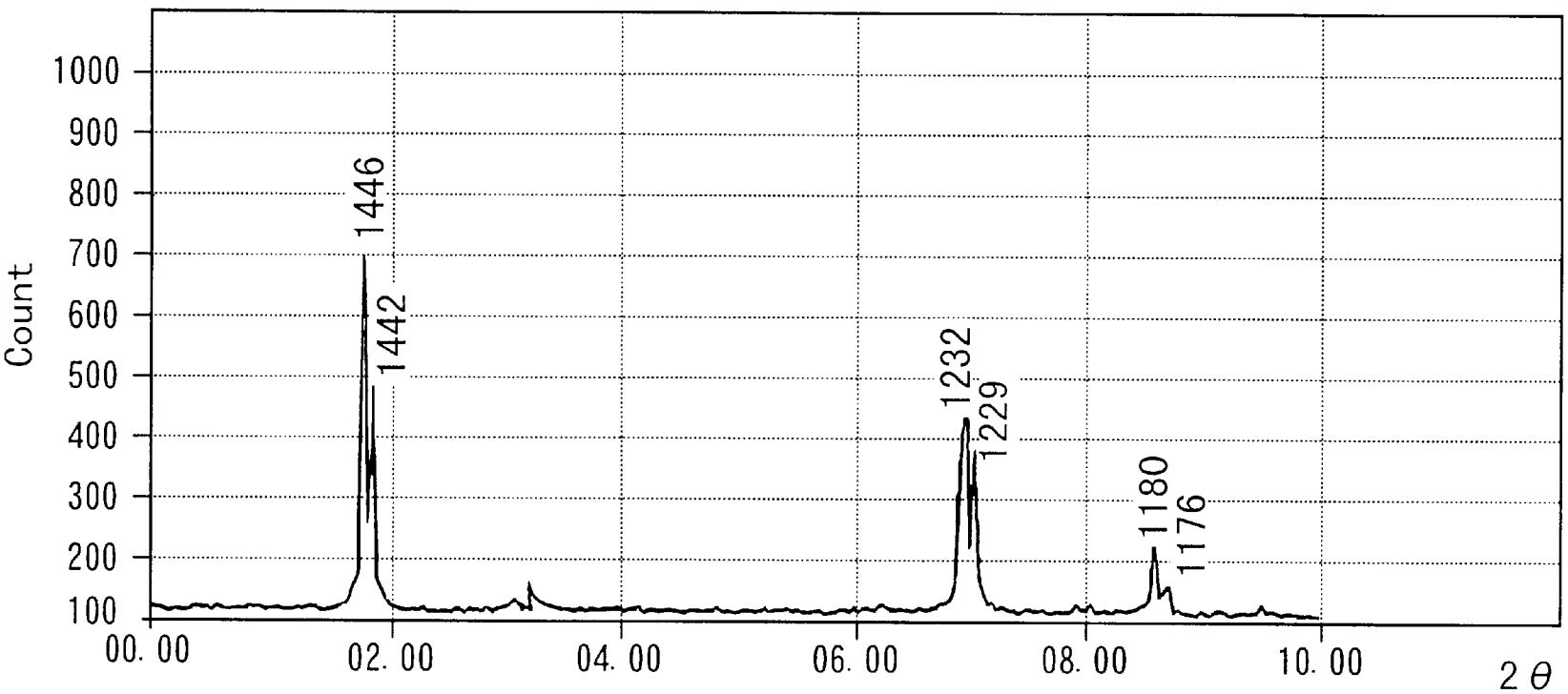
FIG. 4 is a chart showing the X-ray pattern of FIG. 2 as magnified.

FIG. 1 represents the data obtained of a sample heated to 900° C. over a period of about one hour, then retained at 900° C. for 30 minutes, and air cooled. This sample corresponds to a sinter obtained by the conventional method of production. FIG. 2 is an X-ray diffraction pattern obtained of a sample placed in an electric furnace retained in advance at 940° C., rapidly heated for three minutes, and thereafter air cooled. This sample corresponds to a sinter obtained by the method of production according to this invention. FIG. 3 represents an X-ray pattern of FIG. 1 and FIG. 4 an X-ray pattern of FIG. 2, respectively illustrating the measuring axis (2 θ) ranging from 60 degrees to 80 degrees.

It is clearly noted from FIG. 1 and FIG. 2 that a crystal peak of the face centered cube (FFC) of Ag has appeared. From a comparison of the patterns of FIG. 3 and FIG. 4, however, it is clear that the peaks of the planes (2, 2, 0), (3, 1, 1), and (2, 2, 2) in FIG. 4 differ from the peaks of FIG. 3 and their waveforms are split. It is further clear that the intensity ratio of the peaks of the planes of crystal orientation in FIG. 2 is different from that in FIG. 1. From these data, it can be concluded that the sample obtained the rapid heating has experienced a distortion (stress) in the crystal lattice.

It is therefore considered that the increase in rigidity and bending strength due to the rapid heating is ascribable to the fact that the crystal structure possesses a distortion and the lattice constant is consequently differentiated.

EXAMPLES

This invention will now be described more specifically below with reference to working examples.

Example 1

A plastic art grade clayish composition formed of 92 wt. % of pure Ag powder having an average particle diameter of 20 μm, 0.8 wt. % of methyl cellulose, 0.6 wt. % of starch, and 6.6 wt. % of water was prepared.

Then, this plastic art grade clayish composition was formed in a suitable shape and the shaped composition was dried under the conditions of 80° C.×20 minutes.

The interior of a heating furnace was adjusted in advance to a temperature environment in the range of 950° C. (the melting point of pure Ag) –880° C. (a temperature 70° C. lower than the melting point). The shaped composition dried as described above was placed in the heating furnace and fired by rapid heating performed for a prescribed length of time.

The sinter consequently obtained was tested for shrinkage and folding strength. The results of the test and the firing conditions employed are shown in Table 1. In the column "rating" of the table, on the basis of the knowledge that a folding strength exceeding 6 kgf/mm$^2$ suffices for the sake of performing after-treatments including such finishing treatments as polishing, the results of the evaluation are reported by using the symbol "x" for indicating samples having folding strengths not reaching 6 kgf/mm$^2$ without reference to the magnitude of shrinkage and the symbols "A," "B," and "C" for indicating samples having shrinkages respectively of less than 6%, between 6–8%, and not less than 8% while possessing folding strengths invariably exceeding 6 kgf/mm$^2$.

For comparison, a sinter obtained by the conventional method, i.e. by elevating the temperature from normal room temperature to 900° C. or 930° C. a period of one hour and retaining the shaped composition for relating at 900° C. or 930° C. for 30 minutes or 5 minutes was tested similarly for shrinkage and folding strength. The results of this test are additionally shown in Table 1.

TABLE 1

| clayish composition for shaping noble metal compositon | | firing condition | shrinkage | folding strength | evaluation |
|---|---|---|---|---|---|
| pure Ag powder | 92 wt % | 880° C. × 1 min | 4.86% | 5.87 Kgf/mm$^2$ | X |
| methyl cellulose | 0.8 wt % | 880° C. × 2 min | 6.68% | 7.07 Kgf/mm$^2$ | B |
| starch | 0.6 wt % | 880° C. × 3 min | 7.60% | 13.04 Kgf/mm$^2$ | B |
| water | 6.6 wt % | 880° C. × 5 min | 9.22% | 23.98 Kgf/mm$^2$ | C |
| | | 890° C. × 45 sec | 1.76% | 3.02 Kgf/mm$^2$ | X |
| | | 890° C. × 1 min | 4.85% | 6.05 Kgf/mm$^2$ | A |
| | | 890° C. × 2 min | 6.86% | 9.04 Kgf/mm$^2$ | B |
| | | 890° C. × 3 min | 8.76% | 13.74 Kgf/mm$^2$ | C |
| | | 890° C. × 5 min | 9.32% | 25.56 Kgf/mm$^2$ | C |
| | | 900° C. × 45 sec | 1.80% | 3.24 Kgf/mm$^2$ | X |
| | | 900° C. × 1 min | 5.30% | 7.03 Kgf/mm$^2$ | A |
| | | 900° C. × 2 min | 7.68% | 17.03 Kgf/mm$^2$ | B |
| | | 900° C. × 3 min | 9.03% | 14.42 Kgf/mm$^2$ | C |
| | | 900° C. × 5 min | 9.65% | 26.56 Kgf/mm$^2$ | C |
| | | 910° C. × 45 sec | 2.01% | 3.68 Kgf/mm$^2$ | X |
| | | 910° C. × 1 min | 5.89% | 7.95 Kgf/mm$^2$ | A |
| | | 910° C. × 2 min | 7.88% | 14.02 Kgf/mm$^2$ | B |
| | | 910° C. × 3 min | 9.03% | 14.42 Kgf/mm$^2$ | C |
| | | 910° C. × 5 min | 9.80% | 25.43 Kgf/mm$^2$ | C |
| | | 920° C. × 30 sec | 3.02% | 4.06 Kgf/mm$^2$ | X |
| | | 920° C. × 45 sec | 5.06% | 7.95 Kgf/mm$^2$ | A |
| | | 920° C. × 1 min | 5.96% | 13.90 Kgf/mm$^2$ | B |
| | | 920° C. × 2 min | 8.16% | 18.99 Kgf/mm$^2$ | C |
| | | 920° C. × 3 min | 9.66% | 18.17 Kgf/mm$^2$ | C |
| | | 920° C. × 5 min | 10.54% | 27.72 Kgf/mm$^2$ | C |
| | | 930° C. × 30 sec | 2.96% | 4.30 Kgf/mm$^2$ | X |
| | | 930° C. × 45 sec | 4.63% | 8.34 Kgf/mm$^2$ | A |
| | | 930° C. × 1 min | 5.69% | 12.05 Kgf/mm$^2$ | A |
| | | 930° C. × 2 min | 8.69% | 23.51 Kgf/mm$^2$ | C |
| | | 930° C. × 3 min | 9.66% | 22.10 Kgf/mm$^2$ | C |
| | | 930° C. × 5 min | 10.22% | 25.25 Kgf/mm$^2$ | C |
| | | 940° C. × 30 sec | 3.58% | 4.29 Kgf/mm$^2$ | X |
| | | 940° C. × 45 sec | 6.54% | 7.13 Kgf/mm$^2$ | A |
| | | 940° C. × 1 min | 6.40% | 12.08 Kgf/mm$^2$ | A |
| | | 940° C. × 2 min | 8.96% | 20.95 Kgf/mm$^2$ | C |
| | | 940° C. × 3 min | 11.69% | 21.61 Kgf/mm$^2$ | C |
| | | 940° C. × 5 min | 11.48% | 23.05 Kgf/mm$^2$ | C |
| | | 950° C. × 20 sec | 1.50% | 2.99 Kgf/mm$^2$ | X |
| | | 950° C. × 30 sec | 5.12% | 6.22 Kgf/mm$^2$ | A |
| | | 950° C. × 45 sec | 6.32% | 10.43 Kgf/mm$^2$ | B |
| | | 950° C. × 1 min | 6.99% | 12.15 Kgf/mm$^2$ | B |
| | | 950° C. × 2 min | 10.45% | 18.82 Kgf/mm$^2$ | C |
| | | 950° C. × 3 min | 10.41% | 17.23 Kgf/mm$^2$ | C |
| | | 950° C. × 5 min | 10.96% | 22.08 Kgf/mm$^2$ | C |
| temperature elevated from normal temperature to 900° C. over one hour retained at 900° C. for thirty minutes | | | 11.49% | 11.46 Kgf/mm$^2$ | C |
| temperature elevated from normal temperature to 930° C. over one hour retained at 930° C. for five minutes | | | 8.60% | 16.52 Kgf/mm$^2$ | C |

It is clear from Table 1 that in the temperature range of 880–950° C., sinters of high strength and low shrinkage were obtained by two–five minutes' firing. Fully satisfactory results were obtained by one minute's firing at temperatures exceeding 890° C., by 45 seconds' firing at temperatures exceeding 920° C., and by 30 seconds' firing at a temperature of 950° C. Particularly, the sinters obtained in the temperature range of 910–950° C. exhibited less shrinkage and higher strength than the sinters obtained by the conventional method of production.

Example 2

A firing by rapid heating was carried out in the same heating furnace as used in Example 1 by following the procedure of Example 1 except for using a plastic art grade clayish composition formed of 90 wt. % of pure Ag powder having an average particle diameter of 20 $\mu$m, 1.10 wt. % of methyl cellulose, 0.1 wt. % of lignin, and 8.8 wt. % of water. The results were nearly the same as those of Example 1. Part of the results are shown in Table 2.

TABLE 2

| clayish composition for shaping noble metal compositon | | firing condition | shrinkage | folding strength | evaluation |
|---|---|---|---|---|---|
| pure Ag powder | 92 wt % | 930° C. × 1 min | 8.86% | 6.13 Kgf/mm$^2$ | B |
| methyl cellulose | 0.8 wt % | 930° C. × 2 min | 11.15% | 16.31 Kgf/mm$^2$ | C |
| lignin | 0.2 wt % | 930° C. × 5 min | 12.72% | 17.56 Kgf/mm$^2$ | C |
| water | 7.0 wt % | | | | |

Example 3

A firing by rapid heating was carried out in the same heating furnace as used in Example 1 by following the procedure of Example 1 except for using a plastic art grade clayish composition formed of 95 wt. % of k22 Au powder having an average particle diameter of 20 $\mu$m, 0.50 wt. % of methyl cellulose, 0.4 wt. % of starch, and 4.0 wt. % of water. The results were nearly the same as those of Example 1. Part of the results are shown in Table 3.

TABLE 3

| clayish composition for shaping noble metal compositon | | firing condition | shrinkage | folding strength | evaluation |
|---|---|---|---|---|---|
| k22 pure Ag powder | 95 wt % | Φ1030° C. × 1 min | 5.50% | 6.09 Kgf/mm$^2$ | A |
| methyl cellulose | 0.50 wt % | 1030° C. × 3 minΦ | 6.95% | 8.65 Kgf/mm$^2$ | B |
| starch | 0.4 wt % | | | | |
| water | 4.1 wt % | | | | |

Example 4

A firing by rapid heating was carried out by following the procedure of Example 1 except for using a gas burner in the place of the heating furnace. The sinter consequently obtained was tested for shrinkage and folding strength. The firing conditions adopted and the results of the test are shown in Table 4.

TABLE 4

| clayish composition for shaping noble metal compositon | | firing condition | shrinkage | folding strength | evaluation |
|---|---|---|---|---|---|
| pure Ag powder | 92 wt % | gas burner | | | |
| methyl cellulose | 0.8 wt % | 2 sec | 1.84% | 3.24 Kgf/mm$^2$ | X |
| starch | 0.6 wt % | 5 sec | 5.15% | 6.85 Kgf/mm$^2$ | A |
| water | 6.6 wt % | 10 sec | 5.40% | 10.32 Kgf/mm$^2$ | A |
| | | 30 sec | 6.10% | 12.25 Kgf/mm$^2$ | A |
| | | 1 min | 7.16% | 21.19 Kgf/mm$^2$ | B |
| | | 2 min | 8.04% | 16.59 Kgf/mm$^2$ | C |
| | | 3 min | 8.56% | 17.15 Kgf/mm$^2$ | C |
| | | 5 min | 9.32% | 15.44 Kgf/mm$^2$ | C |

The times indicated in the column headid "Firing Conditions" of Table 4 represent the durations from the time the flame of the gas burner was applied to the relevant sample and the time the gas burner was turned off. These times were fixed by adjusting the distances from the samples to the gas burner. The flame of the gas burner had temperatures of 1100–1200° C. at a position of about 1 cm, temperatures of 1000–1100° C. at a position of about 3 cm, and temperatures of about 900° C. at a position of about 5 cm, respectively from the nozzle tip of the burner.

It is clear from Table 4 that the rapid heating effected by the application of the flame of the gas burner produces the same results as those obtained with an electric furnace. Fully satisfactory results are obtained even by such a very brief period as 5–10 seconds. By a period of not less than 30 seconds, the sinter obtained by the method of this invention exhibits higher strength than the sinter obtained by the conventional method of production.

While there have been shown and described preferred embodiments of the invention, it is to be understood that the invention is not limited thereto but may be otherwise variously embodied and practiced within the scope of the claims.

The sinter of noble metal according to this invention is fired by rapid heating as described above. This sinter, as compared with a sinter fired for a long time under complicated temperature management as in the conventional method, sustains only slight shrinkage due to distortion in crystal structure and exhibits high strength.

When the plastic art grade clayish composition or the adhesion type composition is formed of at least one species of noble metal powder selected from the group consisting of pure noble metal powders and noble metal alloy powders and 0.022–3.0 wt. % of a water-soluble cellulose type resin, 0.02–3.0 wt. % of starch, or 0–0.5 wt. % of a reticular macromolecular substance resulting from condensation of a component unit having phenol propane as a backbone, it sustains only slight shrinkage from the practical point of view and sustains no degradation of ornamental property.

The method for the production of a sinter of noble metal according to this invention is capable of easily obtaining the sinter of low shrinkage and high strength mentioned above. Since it effects the firing by rapid heating without requiring the complicated temperature management heretofore found indispensable, it completes the process of firing within an extremely short span of time. Thus, the method of this invention allows a conspicuous reduction of energy cost as compared with the conventional method. The fact that the firing is completed in such a surprisingly brief period can be expected to motivate the creative urge of students in, culture classes.

When the firing is carried out in a kiln or an electric furnace at a temperature in the range of from the melting point of the noble metal powder to the temperature 70° C. lower than the melting point, after the sinter is produced in one cycle and before the sinter is to be produced in the subsequent cycle, the electric furnace or the kiln does not need to be returned to normal room temperature as heretofore practiced but may be used immediately for the subsequent cycle of production of the sinter. Thus, the method of this firing entails only very little waste of time and energy. In this case, the firing can be accomplished even by a very brief period of not more than five minutes.

The firing by rapid heating with the gas burner can be conducted using lower cost equipment as compared with an electric furnace or oven. Since the gas burner can be operated while the firing condition is visually monitored, the operator can quickly reach a high level of skill. A skilled operator, can accomplish the firing in a shorter period than the firing by the use of an electric furnace or oven.

What is claimed is:

1. A sinter of noble metal obtained by a procedure which comprises the steps of forming in a required shape or attaching to a given object a plastic art grade clayish composition or adhesion type composition containing a noble metal powder formed of at least one member selected from the group consisting of pure noble metal powders and noble metal alloy powders, drying to hardness the shaped or adhering composition, and conveying the dried composition into an atmosphere whose temperature is kept beforehand in the range of from the melting point of the noble metal powder to a temperature of about 70° C. below the melting point to heat the conveyed composition.

2. A sinter of noble metal according to claim 1, wherein said plastic art grade clayish composition or adhesion composition comprises at least 78 wt. % of a noble metal powder formed of at least one member selected from the group consisting of pure noble metal powders and noble metal alloy powders, 0.022–3.0 wt. % of a water-soluble cellulose type resin, 0.02–3.0 wt. % of starch, or 0–0.5 wt. % of a reticular macromolecular substance formed by condensation of a component unit having phenyl propane as a backbone as an organic type binder, and water.

3. A sinter of noble metal according to claim 1, wherein the conveyed composition is left standing in said atmosphere for a period between 45 seconds and five minutes.

4. A sinter of noble metal according to claim 2, wherein said reticular macromolecular substance formed by condensation of a component unit having phenyl propane as a backbone s lignin.

5. A method for the production of a sinter of noble metal, which comprises the steps of forming in a required shape or attaching to a given object a plastic art grade clayish composition or adhesion type composition containing a noble metal powder formed of at least one member selected from the group consisting of pure noble metal powders and noble metal alloy powders, drying to hardness the shaped or adhering composition, and conveying the dried composition into an atmosphere whose temperature is kept beforehand in the range of from the melting point of the noble metal powder to a temperature of about 70° C. below the melting point to heat the conveyed composition.

6. A method according to claim 5, wherein said plastic art grade clayish composition or adhesion type composition comprises at least 78 wt. % of a noble metal powder formed of at least one member selected from the group consisting of pure noble metal powders and noble metal alloy powders and 0.022–3.0 wt. % of a water-soluble cellulose type resin, 0.02–3.0 wt. % of starch, or 0–0.5 wt. % of a reticular macromolecular substance formed by condensation of a component unit having phenyl propane as a backbone as an organic type binder.

7. A method according to claim 5, wherein the conveyed composition is left standing in said atmosphere for a period between 45 seconds and five minutes.

8. A method according to claim 6, wherein said reticular macromolecular substance formed by condensation of a component unit having phenyl propane as a backbone is lignin.

* * * * *

UNITED STATES PATENT AND TRADEMARK OFFICE

CERTIFICATE OF CORRECTION

PATENT NO. : 6,290,744 B1
DATED : September 18, 2001
INVENTOR(S) : Atsushi Fujimaru et al.

It is certified that error appears in the above-identified patent and that said Letters Patent is hereby corrected as shown below:

Column 3,
Line 20, " (a starch) " should read -- (α starch) --.

Column 9,
Table 4, the last line under "folding strength" should read -- 18.44 $Kgf/mm^2$ -- instead of "15.44 $Kgf/mm^2$".

Column 12, claim 4,
Line 12, "s" should read -- is --.

Signed and Sealed this

Twelfth Day of March, 2002

*Attest:*

*Attesting Officer*

JAMES E. ROGAN
*Director of the United States Patent and Trademark Office*